US005617684A

United States Patent [19]

Sheath

[11] Patent Number: 5,617,684

[45] Date of Patent: Apr. 8, 1997

[54] GLAZING BAR

[76] Inventor: Gary Sheath, 1A Roman Way, Bedhampton, Havant, Hants, United Kingdom

[21] Appl. No.: 448,410

[22] PCT Filed: Dec. 6, 1993

[86] PCT No.: PCT/GB93/02494

§ 371 Date: Sep. 29, 1995

§ 102(e) Date: Sep. 29, 1995

[87] PCT Pub. No.: WO94/13920

PCT Pub. Date: Jun. 23, 1994

[30] Foreign Application Priority Data

Dec. 4, 1992 [GB] United Kingdom ..... 9225406

[51] Int. Cl.[6] ..... E06B 3/64

[52] U.S. Cl. ..... 52/204.57; 52/204.6; 52/204.68; 52/235

[58] Field of Search ..... 52/235, 456, 214, 52/204.57, 204.6, 204.68

[56] References Cited

U.S. PATENT DOCUMENTS

| | | | |
|---|---|---|---|
| 3,131,440 | 5/1964 | Leeser . | |
| 4,702,055 | 10/1987 | Ralph . | |
| 4,730,429 | 3/1988 | Roberts . | |
| 4,845,911 | 7/1989 | Winston et al. . | |
| 5,040,347 | 8/1991 | Valvis | 52/456 X |

FOREIGN PATENT DOCUMENTS

| | | |
|---|---|---|
| 0300832 | 1/1989 | European Pat. Off. . |
| 1266593 | 6/1961 | France . |
| 8602718 | 5/1986 | Germany . |
| 8607012 | 6/1986 | Germany . |
| 8532985 | 6/1986 | Germany . |
| A535307 | 8/1943 | United Kingdom . |
| 1011881 | 12/1965 | United Kingdom . |
| 2015630 | 9/1979 | United Kingdom . |
| 9104380 | 4/1991 | WIPO . |
| 9114056 | 9/1991 | WIPO . |

*Primary Examiner*—Carl D. Friedman
*Assistant Examiner*—Timothy B. Kang
*Attorney, Agent, or Firm*—Ostrolenk, Faber, Gerb & Soffen, LLP

[57] ABSTRACT

An interlocked grid structure includes one glazing bar extending between and perpendicular to an aligned pair of shorter glazing bars which abut it. Each glazing bar comprises a T-section which is formed by a hollow metal extrusion and a plastics extrusion which are interlocked, and by a plastics cap which is formed by a double beading and which is snap-fitted onto a head portion of the metal extrusion which forms the stem of the T-section and which is load bearing. The plastics extrusion forms the base of the T and provides a seat for a pane of glazing material on either side of the stem. A locating metal plate is embedded in the adjacent ends of the shorter bars to which it is fixed and extends through a lateral aperture in the load bearing stem portion of the glazing bar to locate the shorter bars relative to the glazing bar.

21 Claims, 3 Drawing Sheets

GLAZING BAR

BACKGROUND OF THE INVENTION

This invention relates to a grid structure of mutually perpendicular glazing bars and to a glazing bar in or for such a grid structure. The invention has particular application to glazing bars intended to simulate a traditional timber Georgian-type window effect. An object of the invention is to provide a glazing bar arrangement which allows individual panes of glass, either single or multiple glazed, of a composite window construction to be inserted thereby achieving a true Georgian effect, and to be removed for repair or replacement. Heretofore it has been necessary to remove all the glazed sections in order to replace one section, whereas the present invention allows individual panes of a composite Georgian-type window to be repaired or replaced as required.

U.S. Pat. No. 4,845,911 shows a grid structure for supporting and separating a plurality of individual, relatively small panes of glass. Individual panes can be removed and replaced, but the structure can be disassembled from the outside since all the parts are clipped together and can be unclipped easily. That poses problems of security.

SUMMARY OF THE INVENTION

According to one aspect of this invention, there is provided a grid structure of mutually perpendicular glazing bars comprising at least one glazing bar extending between and substantially perpendicular to an aligned pair of glazing bars which abut it, each glazing bar comprising a central load bearing portion, a base portion which projects from either side, of the central portion to provide a seats for a pane of glazing material, and a formation at a location on the central portion which is spaced from the base portion, and in combination with each glazing bar, a clamping section adapted to be releasably fitted onto the formation whereby to clamp a respective pane of glazing material on each of the seats, wherein there are locating means embedded in the adjacent ends of the bars of the aligned pair and extending therebetween through said one glazing bar whereby to locate the aligned pair of glazing bars substantially relative to one another and to said one glazing bar, the formation being a snap-fit formation, the clamping section being snap-fitted onto it, and the central load bearing portion and the base portion being interlocked, wherein each glazing bar has a uniform cross-section, an outer end portion of each central load bearing portion of each glazing bar that forms the snap-fit formation and that extends outwardly beyond that part of the clamping section that is nearest to the seat when the clamping section is snap-fitted onto the formation, and the other outer end portion of each central load bearing portion that extends outwardly beyond the seat are solid, and the solid outer end portions are interconnected by a mid-portion which is hollow, the interior of the hollow portion being formed centrally of the central load bearing portion and extending along the length thereof, and the locating, means embedded in the adjacent end of the aligned pair of glazing bars are received within the interior of the hollow load bearing portions thereof and extend through a lateral aperture formed solely through the hollow mid-portion of the central load bearing portion of the intervening said one glazing bar whereby they are embedded therein.

Preferred features of the grid structure are also described in sub-claims 2 to 7.

A Georgian type window incorporating a grid structure in which this invention is embodied will have substantial strength such as to withstand considerable wind loads and other loads to which it may be subjected when installed. Also the preferred embodiment of this invention has a high standard of security being most difficult to disassemble from outside even should the clamping section be removed. That is because, even though the clamping sections can be stripped off and they are on the outside, the rest of the grid structure cannot be disassembled because the locating means are inaccessible being embedded in the glazing bars. Also the individual panes are difficult to extract from the grid structure without being broken., when working from outside, because they fit snugly with edges in abutment with the glazing bars. Moreover the security tape by which the panes of glass are bonded in situ is inaccesible from outside.

According to another aspect of this invention in or for a grid structure according to said one aspect of this invention there is provided a glazing bar comprising a central load bearing portion, a base portion which projects from either side of the central portion to provide a seat for a pane of glazing material, and a snap-fit formation at a location on the central portion which is spaced from the base portion and operable to receive a snap-fit clamping section which is to be snap-fitted thereon whereby to clamp a respective pane of glazing material on each of said seats, wherein the central load bearing portion and the base portion are interlocked and the glazing bar has a uniform cross-section wherein an outer end portion which forms said snap-fit formation and the other outer end portion that extends beyond the seat are solid, and the outer end portions are interconnected by a mid-portion which is hollow, the interior of the hollow portion being formed centrally of the central load bearing portion and extending along the length thereof, and a lateral aperture is formed solely through said hollow mid-portion of the load bearing portion.

A further aspect of this invention comprises the use of a glazing bar in a grid structure according to said one aspect of this invention, the glazing bar comprising a central load bearing portion, a base portion which projects from either side of the central portion to provide a seat for a pane of glazing material, and a snap-fit formation at a location on the central portion which is spaced from the base portion and operable to receive a snap-fit clamping section which is to be snap-fitted thereon whereby to clamp a respective pane of glazing material on each of said seats, wherein the central load bearing portion and the base portion are interlocked and the glazing bar has a uniform cross-section wherein an outer end portion which forms said snap-fit formation and the other outer end portion that extends beyond said seat are solid, and the outer end portions are interconnected by a mid-portion which is hollow, the interior of the hollow portion being formed centrally of the central load bearing portion and extending along the length thereof. The use is preferably of a glazing bar having features as claimed in sub-claims 19 to 21.

BRIEF DESCRIPTION OF THE DRAWINGS

One form of a Georgian window in which this invention is embodied, and a modification thereof, is described now by way of example with reference to the accompanying drawings of which:

FIG. 1 shows a window of the Georgian style. It comprises an outer rectangular frame 10 and peripheral beading 11 both formed of uPVC extrusions. The frame 10 and beading 11 are similar to that used in conventional uPVC windows.

Figure 1:
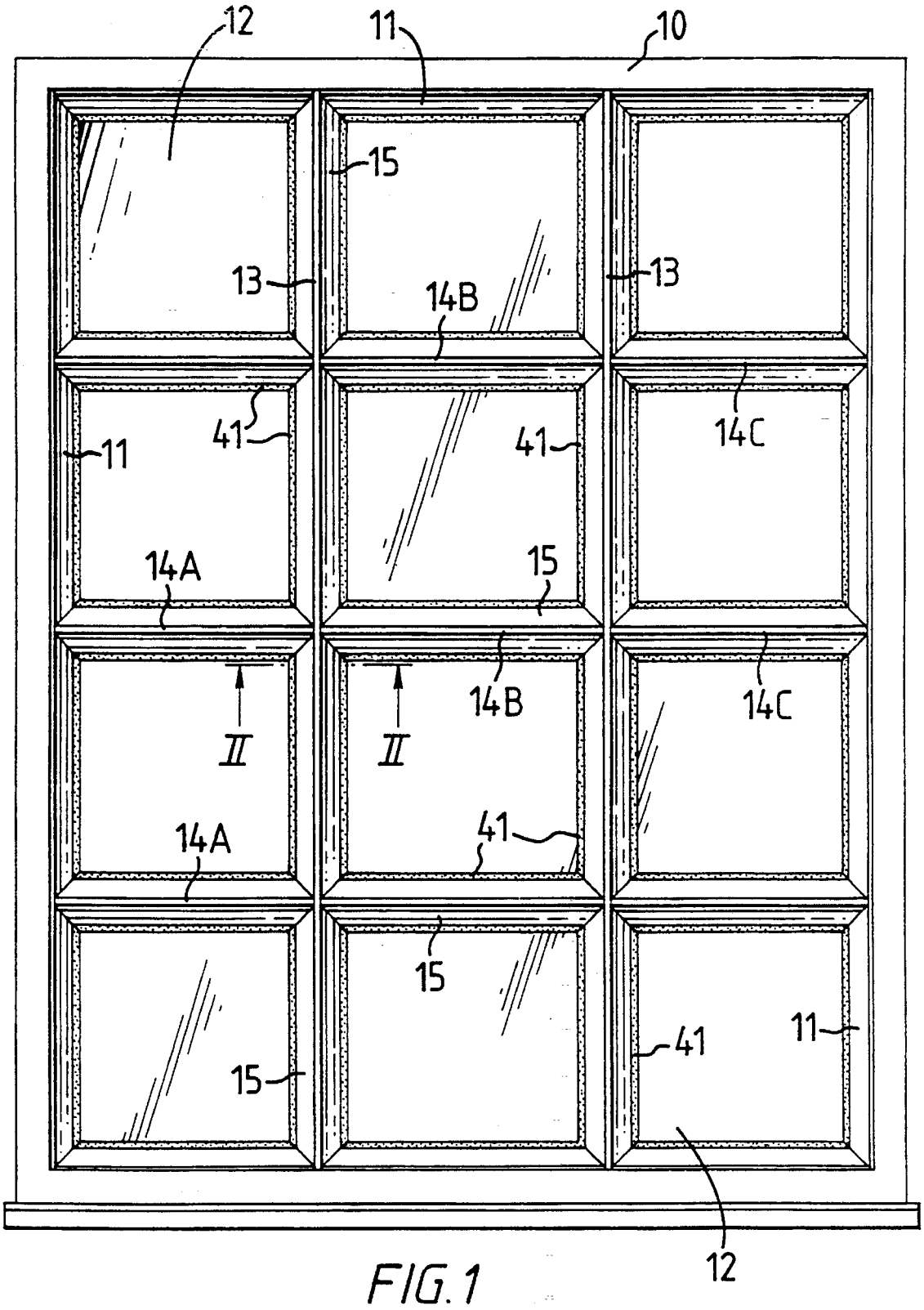
FIG. 1 is a front elevation of the Georgian window.
Figure 2:
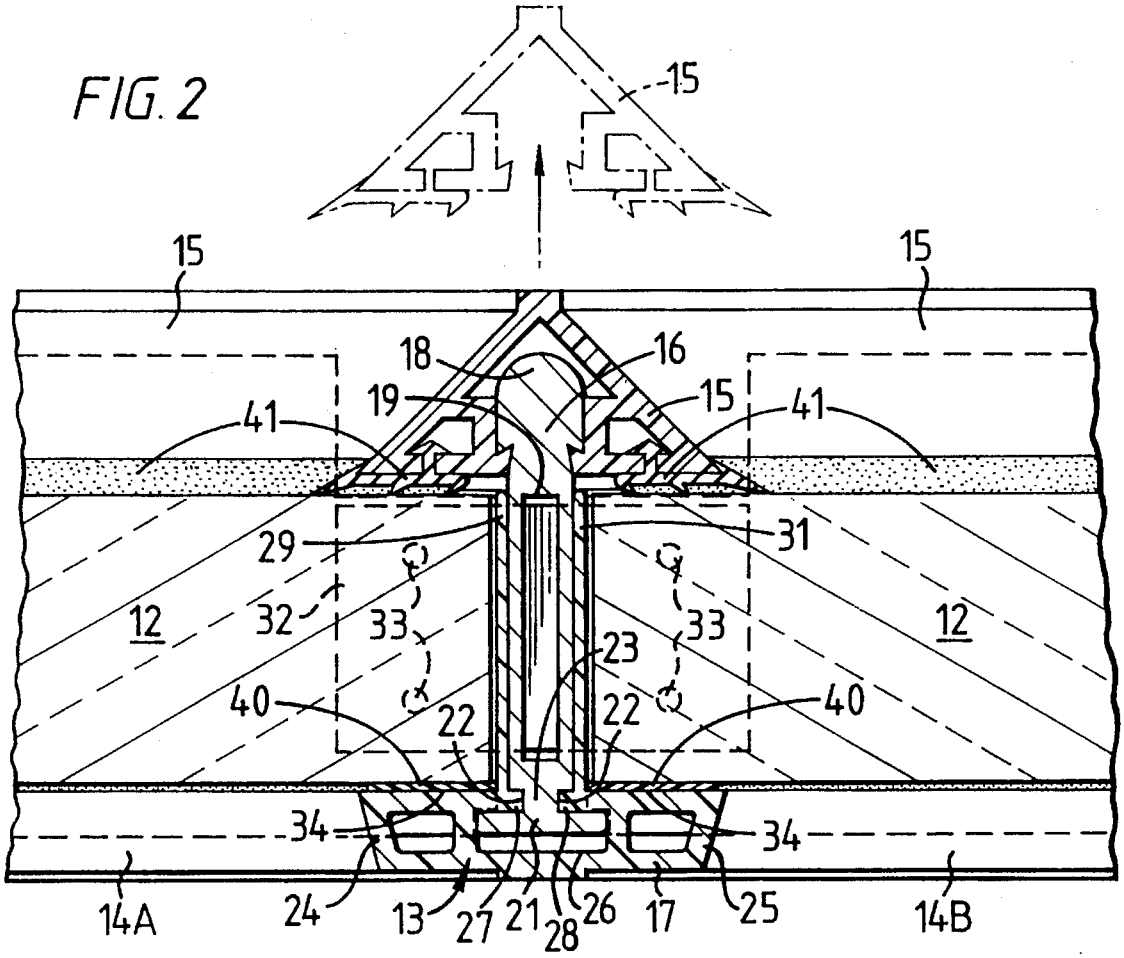
FIG. 2 is a section on the line II—II in FIG. 1 with the releasable snap-fit cap shown displaced in dotted outline.

The rectangular aperture formed by the frame 10 is divided into smaller rectangular apertures for individual panes 12 of glass by vertical glazing bars 13, which extend from the top to the bottom of the frame 10, and by horizontal rows of aligned shorter glazing bars 14A–14C. Each vertical glazing bar 13 extends between and is perpendicular to an aligned pair 14A and 14B, 14B and 14C of the shorter glazing bars which abut it. Each glazing bar 13,14A,14B, 14C carries its own beading cap 15 which is effectively an integrated pair of strips of the conventional beading 11 arranged symmetrically and adapted to be snap- fitted onto the remainder of the respective glazing bars as shown in FIG. 2. Mitered joints are formed at the junction of the peripheral beading 11 with an end of a respective one of both the vertical glazing bars 13 and the outer horizontal glazing bars 14A and 14C, in much the same way as they are formed between the strips of peripheral beading 11 at each corner of the frame 10.

Suitable fixing means are provided at each junction between the frame 10 and an end of a glazing bar 13,14A, 14C. For instance, the fixing means may comprise screws engaged in the hollow of the metal extrusion 16 of the respective glazing bar.

Each pane 12 of glass to be fitted into one of the smaller rectangular apertures may be either a single pane of glass or a multiple glazed unit.

FIG. 2 shows the cross-section of a vertical glazing bar 13. That is similar to the cross-section of each of the shorter horizontal glazing bars 14A, 14B and 14C. It shows that each glazing bar comprises a T section which is formed by two interlocked extrusions 16 and 17 and the cap formed by the double beading 15. The stem of the T comprises the extrusion 16 which is formed of metal. That has a domed arrow-head 18 at its outer end on which the double beading 15 is snap-fitted. It is hollow having an elongate rectangular slot 19 formed centrally in it, the slot extending along the length of the stem. The end 21 of the metal extrusion 16 remote from the domed arrow-head 18 is flanged on both sides so that its width is greater than that of the remainder of the metal extrusion 16. Also the flanged end 21 is spaced from the major hollow portion of the metal extrusion 16 by an opposed pair of recesses 22 which form a waist portion 23. It follows that the metal extrusion 16 is a high-I value metal beam comprising solid outer end portions, namely the domed arrow-head 18 at one end and the flanged end 21 and the waist portion 23 at the other end, interconnected by a hollow mid-portion which is the stem of the T.

The plastics extrusion 17 forms a base portion of the glazing bar, that base portion projecting from either side of the central portion of the glazing bar to form the arms 24 and 25 of the T. A central aperture 26 is formed in the extrusion 17 and is sized to snugly receive the flanged end portion 21 of the metal extrusion 16. The latter projects upwardly from that central aperture 26 through an opening which is formed by flange portions 27 and 28 of the plastics extrusion 17 which each project into a respective one of the recesses 22 in which they are a snug fit. Hence the two extrusions 16 and 17 are interlocked. The plastics extrusion 17 includes a pair of upstanding thin portions 29 and 31 which line the respective side of the hollow central portion of the metal extrusion 16, extending over a major part of the stem of the T.

FIG. 2 shows that the upper part, including the domed arrow-head 18 of each of the aligned pair of shorter glazing bars 14A and 14B for example is cut away to provide clearance for the double beading cap 15 snap-fitted onto the domed arrow-head portion 18 of that intervening vertical glazing bar 13. Mitred joints are formed between juxtaposed portions of the arms 24 and 25. The lower corners of the metal extrusions 16 of the aligned pair of shorter glazing bars 14A and 14B are also cut away to receive the flanged end 21 of the metal extrusion 16, of the intervening glazing bar 13, there being a slot formed in the respective arm 24,25 to receive the metal extrusion 16 of the respective shorter glazing bar 14A,14B. The remainder of the ends of those metal extrusions 16 of the aligned pair of short glazing bars 14A and 14B, 14B and 14C abut the respective upstanding thin portion 29,31 of the plastics extrusion 17. A metal plate 32 is fitted into the slot 19 at either end of the aligned pair of shorter glazing bars 14A and 14B, 14B and 14C, and extends through a lateral aperture formed through the stem portion of the T-shaped vertical glazing bar 13, the plate 32 being fixed at either end to the respective shorter glazing bar 14A,14B,14C by rivets 33. Other suitable fixing means, such as countersunk setscrews or self-tapping screws could be used instead of the rivets 33.

It will be realised that the grid structure formed by the vertical and horizontal glazing bars 13,14A,14B and 14C, fitted into the central aperture of the frame 10, and the plates 32 by which each aligned pair of shorter glazing bars 14A and 14B are joined together and located relative to the intervening vertical glazing bar 13 comprise an interlocked structure. Loads applied to that structure will be uniformly distributed throughout that structure. The grid structure is designed to be self-supporting and self-sustaining even without any panes 12 of glass being fitted into its apertures so it can be transported to a site at which it is to be installed, the panes 12 of glass being fitted after it has been installed.

The double beading caps 15 are separated from the respective arrowhead portions 18 of the respective glazing bars (as shown dotted in FIG. 2) to free each aperture for insertion of a pane 12 of glass. The seat portion 34 afforded by each arm of the T that is formed by the plastics extrusion 17 at the corner formed between that arm and the stem and which extends over the outer part of the flanged end 21 of the metal extrusion, is lined with a strip of security tape 40. That is a strip of material with a layer of self-adhesive on each of its opposed faces. Hence that strip adheres to the respective portion of the plastics extrusion 17 which forms the seat 34 and provides an adhesive layer on which the pane 12 of glass is laid. Hence the pane 12 of glass is bonded to its seat 34. Also the pane 12 of glass closely abuts the edge of the stem of the T-section of the respective glazing bar along the respective edge of the pane 12 of glass. The respective upstanding stem portion 29,31 of the plastics extrusion 17 lies between the glass and the metal extrusion 16 so as to avoid direct glass and metal contact. Once the pane 12 of glass has been laid upon and bonded to the respective seat 34, the double beading cap 15 is fitted to clamp it in position, a respective gasket 41 carried by the cap 15 being urged by the resilience of its material against the pane 12. The resilient compressibility of the gasket material allows the cap 15 to be snap-fitted onto the arrowhead 18 and ensures that that material makes sealing contact with the glass when it has been so fitted.

It will be understood that the panes 12 of glass augment the structural integrity of the total window structure by filling the apertures and abutting the portions of glazing bars that form the periphery of those apertures. Furthermore it is extremely difficult to extract each pane 12 of glass from the side of the window on which the double beading caps 15 run, even when those caps have been released from the respective domed arrowheads 18, because of the double adhesive security strip. On the other hand it is a simple process to replace a pane of glass by first removing the respective double beading caps 15 and then cutting the security strips with a knife, working from inside the window.

Figure 3:
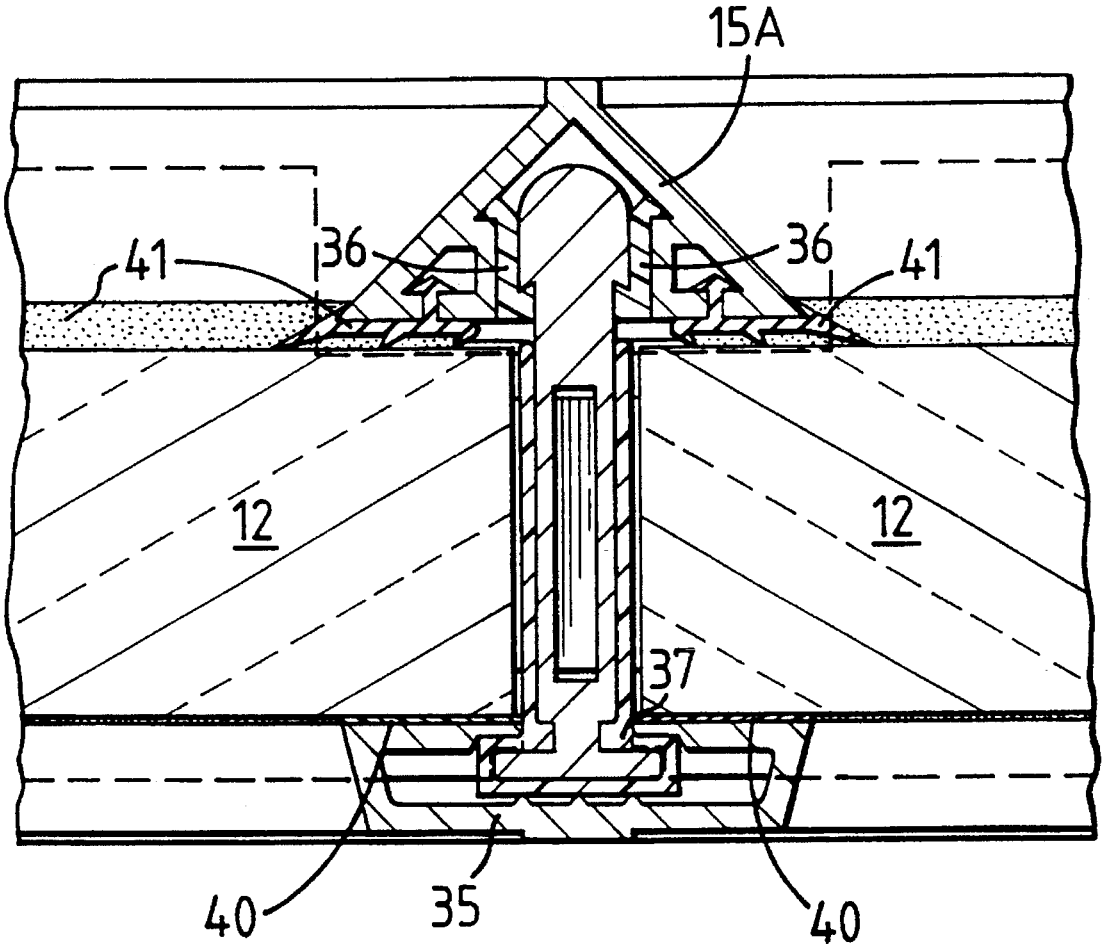
FIG. 3 shows a modified form of glazing bar for use in the window shown in FIGS. 1 and 2.

FIG. 3 shows an alternative form of glazing bar which employs metal extrusions for the double beading cap 15A and the base portion 35 which forms the arms of the T. Intermediate extrusions 36 and 37 of plastics material are one 37 which is between the central metal extrusion 16 and the other metal extrusion 35 which forms the arms of the T. This extrusion 37 includes the upstanding thin portions which line the sides of the stem portion of the T.

In either embodiment described above, a compressible gasket could be used instead of the security tape although the resultant window would be less secure than it would have been had security tape been used.

I claim:

1. A grid structure of mutually perpendicular glazing bars comprising at least one glazing bar extending between and substantially perpendicular to an aligned pair of glazing bars, each glazing bar comprising a central load bearing portion, a base portion which projects from either side of the central portion to provide a seat for a pane of glazing material, and a snap fit formation at a location on the central portion which is spaced from the base portion, and in combination with each glazing bar, a clamping section adapted to be releasably snap fitted onto the snap fit formation whereby to clamp a respective pane of glazing material on each of said seats, locating means embedded in the adjacent ends of the bars of the aligned pair and extending therebetween through said one glazing bar and operable to locate the aligned pair of glazing bars substantially relative on one another and to said one glazing bar, a clamping section releasably snap-fitted onto the snap-fit formation whereby to clamp a respective pane of glazing material on each of said seats, the central load bearing portion and the base portion being interlocked, wherein each glazing bar has a uniform cross-section, an outer end portion of each central load bearing portion of each glazing bar that forms said snap-fit formation and that extends outwardly beyond that part of said clamping section that is nearest to said seat when said clamping section is snap-fitted onto said formation, and the other outer end portion of each central load bearing portion that extends outwardly beyond said seat are solid, and said solid outer end portions are interconnected by a mid-portion which is hollow, the interior of the hollow portion being disposed centrally of the central load bearing portion and extending along the length thereof and the locating means embedded in the adjacent ends of the aligned pair of glazing bars are received within the interior of the hollow load bearing portions thereof and extending through a lateral aperture formed solely through the hollow mid-portion of the central load bearing portion of the intervening said one glazing bar whereby they are embedded therein.

2. A grid structure according to claim 1, wherein said snap-fit formation comprises a domed arrow-head.

3. A grid structure according to claim 2, wherein the domed arrow head has a leading edge and a symmetrically disposed pair of barbs spaced from a tip of the leading edge.

4. A grid structure according to claim 1, wherein the central load bearing portion and the base portion are interlocked by each having a flange portion that is formed on it fitted snugly into a respective recess or aperture formed in the other of the central load bearing portion and the base portion.

5. A grid structure according to claim 1, wherein the locating means comprise a plate which is spigotted at either end into a correspondingly shaped cavity formed by the hollow interior of the respective one of the aligned pair of glazing bars and is fixed at either end to the respective glazing bar.

6. A grid structure according to claim 1, glazed with panes of glazing material, wherein each pane seated on a respective one of said seats is adhesively secured to said seat by security tape which has adhesive on both sides, one side being bonded to the seat and the other side being bonded to the pane of glass seated thereon.

7. A grid structure according to claim 1, wherein at least that part of the clamping section which engages the snap-fit formation is formed of a plastics material.

8. In a grid structure of mutually perpendicular glazing bars comprising at least one glazing bar extending between and substantially perpendicular to an aligned pair of glazing bars, said one glazing bar comprising a central load bearing portion, a base portion which projects from either side of the central portion to provide a seat for a pane of glazing material, and a snap-fit formation at a location on the central portion which is spaced from the base portion and operable to receive a snap-fit clamping section which is to be snap-fitted thereon whereby to clamp a respective pane of glazing material on each of said seats, in which the central load bearing portion and the base portion are interlocked, the improvement comprising said one glazing bar having a uniform cross-section wherein an outer end portion which forms said snap-fit formation and the other outer end portion that extends beyond said seat are solid, and said outer end portions are interconnected by a mid-portion which is hollow, the interior of the hollow-portion being disposed centrally of the load bearing portion and extending along the length thereof, and a lateral aperture formed solely through said hollow mid-portion of the load bearing portion.

9. In a grid structure, a glazing bar according to claim 8, wherein the central load bearing portion is a hollow extrusion.

10. In a grid structure, a glazing bar according to claim 8, wherein said snap-fit formation comprises a domed arrow-head.

11. In a grid structure, a glazing bar according to claim 10, wherein the domed arrow-head has a leading edge and a symmetrically disposed pair of barbs spaced from the tip of the leading edge substantially by the diameter of the leading edge.

12. In a grid structure, a glazing bar according to claim 8, wherein the central load bearing portion and the base portion are interlocked by each having a flange portion that is formed on it fitted snugly into a respective recess or aperture formed in the other of the load bearing portion and the base portion.

13. In a grid structure, a glazing bar according to claim 8, wherein the central load bearing portion is formed of metal.

14. In a grid structure, a glazing bar according to claim 8, wherein each glazing bar has a T-section, the load bearing portion forming at least part of the stem of the T and being embedded in the base portion which comprises an extrusion which forms the arms of the T.

15. In a grid structure, a glazing bar according to claim 14, wherein the base portion comprises an extrusion of plastics material.

16. In a grid structure, a glazing bar according to claim 15, wherein the extrusion of plastics material includes portions which line either side of the central load bearing portion over a major part of the stem thereby to separate the metal load bearing portion from glass of a pane clamped on either side of it.

17. In a grid structure, a glazing bar according to claim 14, wherein the central load bearing portion is formed of metal and the base portion comprises a metal extrusion which forms the arms of the T and a plastics extrusion which is sandwiched between the metal extrusion and the metal load bearing portion.

18. A glazing bar having a uniform cross-section and comprising a central load bearing portion, a base portion which projects from either side of the central load bearing portion to provide a seat for a pane of glazing material, and a snap-fit formation at a location on the central load bearing portion which is spaced from the base portion, and which is operable to receive a clamping section adapted to be releasably snap-fitted onto the snap-fit formation whereby to clamp a respective pane of glazing material on each of said seats, wherein the improvement comprises said central load bearing portion being a high-I value beam comprising solid outer end portions interconnected by a hollow mid-portion, the solid outer end portions consisting at least of those portions of the beam that extend outwardly beyond respective panes of glazing material that are clamped on said seats by said clamping section when structure in which said glazing bar is incorporated, is glazed.

19. A glazing bar according to claim 18, wherein said snap-fit formation comprises a domed arrow-head.

20. A glazing bar according to claim 19, wherein the domed arrow-head has a leading edge and a symmetrically disposed pair of barbs spaced from a tip of the leading edge.

21. A glazing bar according to claim 18, wherein the central load bearing portion and the base portion are interlocked by each having a flange portion which is formed on it fitted snugly into a respective recess or aperture formed in the other of the central load bearing portion and the base portion.

* * * * *